US010377018B2

(12) United States Patent
Pahl et al.

(10) Patent No.: US 10,377,018 B2
(45) **Date of Patent: *Aug. 13, 2019**

(54) COARSE SANDPAPER WITH NON-SLIP COATING LAYER

(75) Inventors: Thomas E. Pahl, Ames, IA (US); John G. Petersen, Center City, MN (US); Michael P. Wald, Ankeny, IA (US)

(73) Assignee: 3M Innovative Properties Company, St. Paul, MN (US)

( * ) Notice: Subject to any disclaimer, the term of this patent is extended or adjusted under 35 U.S.C. 154(b) by 773 days.

This patent is subject to a terminal disclaimer.

(21) Appl. No.: 13/412,955

(22) Filed: Mar. 6, 2012

(65) Prior Publication Data

US 2012/0231708 A1 Sep. 13, 2012

Related U.S. Application Data

(60) Provisional application No. 61/498,685, filed on Jun. 20, 2011, provisional application No. 61/451,678, filed on Mar. 11, 2011.

(51) Int. Cl.
*B24D 11/02* (2006.01)
*B24D 3/34* (2006.01)

(52) U.S. Cl.
CPC ..... *B24D 11/02* (2013.01); *B24D 3/346* (2013.01)

(58) Field of Classification Search
CPC ..... B24D 11/02; B24D 3/346
USPC ..... 451/59, 533, 538, 539
See application file for complete search history.

(56) References Cited

U.S. PATENT DOCUMENTS

| | | | | |
|---|---|---|---|---|
| 2,595,733 | A * | 5/1952 | Martin | B24D 11/00 51/298 |
| 3,030,742 | A | 4/1962 | Costello | |
| 4,202,139 | A | 5/1980 | Hong | |
| 4,714,644 | A | 12/1987 | Rich | |
| 5,109,638 | A | 5/1992 | Kime | |
| 5,382,615 | A | 1/1995 | Godfrey | |
| 5,514,028 | A | 5/1996 | Ali | |
| 5,520,957 | A | 5/1996 | Bange | |
| 5,807,161 | A | 9/1998 | Manor | |
| 5,984,989 | A | 11/1999 | Davison | |
| 6,110,015 | A | 8/2000 | Christianson | |
| 6,531,212 | B2 * | 3/2003 | Owusu et al. | 428/323 |
| 6,613,113 | B2 | 9/2003 | Minick | |
| 8,052,822 | B2 * | 11/2011 | Datta et al. | 156/242 |

(Continued)

FOREIGN PATENT DOCUMENTS

| | | |
|---|---|---|
| EP | 2 241 603 A1 | 10/2010 |
| WO | WO 95-18755 | 7/1995 |
| WO | WO 2010-002697 | 1/2010 |

OTHER PUBLICATIONS

Making Sense of Sandpaper—http://www.jamarco.com/91b_Technical/sandpaper/Making%20Sense%20of%20Sandpaper%20-%20Page%202%20-%20Fine%20Woodworking.htm.*

(Continued)

*Primary Examiner* — Eileen P Morgan
(74) *Attorney, Agent, or Firm* — Kenneth B. Wood

(57) ABSTRACT

A sheet of coarse sandpaper includes a backing layer having opposed first and second major surfaces, an adhesive make coat on the second major surface, coarse abrasive particles at least partially embedded in the make coat, thereby defining a coarse abrasive surface, and an exposed non-slip coating layer on the first major surface. Methods of making and using such coarse sandpaper are also provided.

15 Claims, 1 Drawing Sheet

(56) References Cited

U.S. PATENT DOCUMENTS

| | | | | |
|---|---|---|---|---|
| 2002/0155283 | A1* | 10/2002 | Carter et al. | 428/343 |
| 2003/0119437 | A1 | 6/2003 | Rich | |
| 2006/0246830 | A1 | 11/2006 | Kirschhoffer | |
| 2009/0325470 | A1* | 12/2009 | Petersen | 451/59 |
| 2010/0009604 | A1 | 1/2010 | Petersen | |
| 2011/0021122 | A1 | 1/2011 | Mackay | |

OTHER PUBLICATIONS

International Search Report, PCT/US2012/027839, dated Aug. 29, 2012, 3 pages.
U.S. Appl. No. 13/494,590, Petersen, filed Jun. 12, 2012.
U.S. Appl. No. 13/412,924, Pahl, filed Mar. 6, 2012.
U.S. Appl. No. 13/489,530, Petersen, filed Jun. 6, 2012.
International Search Report, PCT/US2012/027843, dated Sep. 24, 2012, 3 pages.
Extended European Search Report, Application No. 12758232.8, dated Jul. 25, 2014, 3 pages.
Purdy, Strother. Sandpaper: Knowing How it Works . . . [online][retrieved on Mar. 15, 2017]. Retrieved from the Internet: <URL: http://www.jamarco.com/91/b_Technical/sandpaper/Making%20Sense%20of%20Sandpaper%20-%20Page%201%20-%20Fine%20Woodworking.htm> p. 1 (of 4 Pages).

* cited by examiner

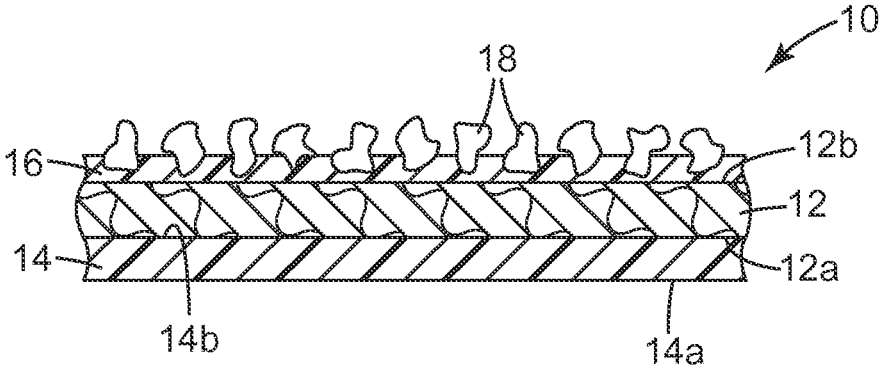
10
18
16
12b
12
14
12a
14b
14a

COARSE SANDPAPER WITH NON-SLIP COATING LAYER

CROSS REFERENCE TO RELATED APPLICATIONS

This application claims the benefit of U.S. Provisional Patent Application Nos. 61/451,678, filed Mar. 11, 2011, and 61/498,685, filed Jun. 20, 2011, the disclosures of both of which are incorporated by reference herein in their entirety.

BACKGROUND

Sheet-like abrasive articles are commonly used in a variety of sanding operations including, for example, hand sanding of wooden surfaces. Such abrasive articles often comprise an abrasive front surface and a non-abrasive back surface. In hand sanding, a user may hold the abrasive article and move the abrasive article across a work surface, often with the abrasive article folded or otherwise manipulated so that an area of the back surface is in contact with another area of the back surface (e.g., with the article folded against itself with the abrasive front surface exposed). Loose particulates may often be liberated or generated in the course of using the abrasive article. Such particulates may, if they come between the contacting areas of the back surface, cause increased slipping of the back surface contacting areas relative to each other, which can be disadvantageous.

SUMMARY

The present invention provides a coarse abrasive article, e.g. a sheet of coarse sandpaper, comprising a backing layer having opposed first and second major surfaces, an adhesive make coat on the second major surface, coarse abrasive particles at least partially embedded in the make coat, thereby defining a coarse abrasive surface, and an exposed non-slip coating layer on the first major surface.

In one aspect, disclosed herein is a sheet of coarse sandpaper, comprising: (a) a flexible backing layer having opposed first and second major surfaces; (b) an adhesive make coat on the second major surface; (c) coarse abrasive particles at least partially embedded in the make coat, thereby defining a coarse abrasive surface; and (d) an exposed non-slip coating layer on the first major surface, wherein the nonslip coating layer comprises a base resin and an effective amount of a tackifying resin.

In another aspect, disclosed herein is a method of making a sheet of coarse sandpaper having a non-slip coating layer, comprising the steps of: (a) providing a paper backing layer having opposed first and second major surfaces; (b) coating an adhesive make coat on the second major surface; (c) at least partially embedding abrasive particles in the make coat, thereby forming an abrasive surface; and (d) hot-melt coating a non-slip coating layer comprising at least one base resin and at least one tackifying resin on the first major surface.

BRIEF DESCRIPTION OF THE DRAWING

The present invention will be further described with reference to the accompanying FIGURE, which is a cross sectional view of an exemplary sheet of coarse sandpaper according to the invention.

DETAILED DESCRIPTION

Referring now to the drawing, the FIGURE shows a cross-section of a flexible sheet-like coarse abrasive article

10, such as a sheet of coarse sandpaper, comprising a flexible backing layer 12 having opposed first 12*a* and second 12*b* major surfaces, a flexible non-slip coating layer 14 on the backing layer first major surface 12*a*, an adhesive make coat layer 16 on the backing layer second major surface 12*b*, and a plurality of coarse abrasive particles 18 at least partially embedded in the make coat layer 16. The coarse abrasive article 10 may be provided in, for example, a stack of individual sheets, or in roll form, wherein the coarse abrasive article 10 may have an indefinite length.

As used herein, the expression "sheet-like" refers generally to the broad, thin, flexible nature of coarse abrasive article 10. The terms front side and front surface will be used herein to denote the side and surface comprising the coarse abrasive, and the terms back side and back surface will be used to denote the side bearing the non-slip coating layer (i.e., the side opposite the coarse abrasive), and the outer surface of the non-slip coating layer. As used herein, the terms "coating", "coating layer" etc., refer generally to at least a single layer of flowable material, such as a liquid or a solid powder, that is applied directly to a surface. A coating, therefore, does not include a separate sheet of material laminated to a surface. As used herein, the expression "layer" denotes that the coating of non-slip material is in the form of a discrete stratum on top of the backing layer 12 (i.e. the non-slip material does not soak through the entire thickness of the backing layer 12). In some embodiments, non-slip coating layer 14 consists of a single layer.

In some embodiments, non-slip coating layer 14 (e.g., major inward-facing surface 14*b* of layer 14) may be in direct contact with first major surface 12*a* of backing layer 12. In other embodiments, one or more intermediate primer layers, tie layers, or the like may be present between major surface 12*a* of backing layer 12 and non-slip coating layer 14 and may e.g. improve the adhesion of non-slip coating layer 14 to backing layer 12. If present, in various embodiments such intermediate layers may be less than about 100 microns, less than about 50 microns, less than about 25 microns, or less than about 10 microns in thickness, and may be applied e.g. by coating, vapor deposition, etc. In some embodiments such intermediate layers may comprise dense layers (e.g., lacking porosity), and by definition they do not encompass layers such as sponge layers, foam layers, synthetic microporous membranes, and the like.

Non-slip coating layer 14 is an exposed layer. By this is meant that at least about 25% of outward-facing surface 14*a* of non-slip coating layer 14 is an exposed surface that, as article 10 is provided to an end user, is not covered, buried, or obscured by any other layer, except for, optionally, such items as labels, stickers, price tags, temporary protective sheets or liners, or the like, which are not permanently attached to non-slip coating layer 14 and which may be removed if desired prior to use of article 10. In various embodiments, at least about 50%, at least about 75%, or at least 90%, of outer surface 14*a* of non-slip coating 14 is an exposed surface. In some embodiments, the entirety of outer surface 14*a* of non-slip coating layer consists of an exposed surface.

Suitable materials for flexible backing layer 12 may include any of the materials commonly used to make sandpaper including, for example, paper, cloths (cotton, polyester, rayon), polymeric films such as thermoplastic films, foams, and laminates thereof. The backing layer 12 will have sufficient strength for handling during processing, sufficient strength to be used for the intended end use application, and the ability to have non-slip coating 14 and make coat 16 applied to at least one of its major surfaces.

In the illustrated embodiment, backing layer 12 is formed of paper. Paper is a desirable material for backing layer 12 because it is readily available and is typically low in cost. Conventional sandpaper, however, which has a paper backing layer, has limited durability, and has a smooth slippery surface that makes conventional sandpaper difficult to move over a work surface and, therefore, makes sanding difficult. Paper backings are available in various weights, which are usually designated using letters ranging from "A" to "F". The letter "A" is used to designate the lightest weight papers, and the letter "F" is used to designate the heaviest weight papers.

In the illustrated embodiment of the FIGURE, backing layer 12 is continuous. That is, backing layer 12 does not contain holes, openings, slits, voids, or channels extending there through in the Z-direction (i.e. the thickness or height dimension) that are larger than the randomly formed spaces between the material itself when it is made. The backing may also contain openings (i.e. be perforated), or contain slits. Backing layer 12 is also generally non-extensible. Non-extensible refers to a material having an elongation at break of typically no greater than about 25%, no greater than about 10%, or no greater than about 5%.

In certain embodiments, e.g. when backing layer 12 is formed of paper, backing layer 12 may be relatively thin, and typically has a thickness of no greater than about 1.5 mm, no greater than about 1 mm, or no greater than about 0.75 mm. In such embodiments, the backing layer 12 is generally not resilient. The backing layer 12 may be porous or non-porous. In some embodiments, backing layer 12 consists of a single layer.

In some embodiments, backing layer 12 may be formed of a cloth material or film, such as a polymeric film. Cloth materials may be desirable because they are generally tear resistant and are generally more durable than paper and film materials. In addition, cloth backings tolerate repeated bending and flexing during use. Cloth backings are generally formed of woven cotton or synthetic yarns that are treated to make them suitable for use as a coated abrasive backing. As is the case with paper backings, cloth backings are available in various weights, which are usually designated using a letter ranging from "J" to "M" with the letter "J" designating the lightest weight cloth, and the letter "M" designating the heaviest weight cloths.

Suitable film materials for the backing layer 12 may include polymeric films, including primed films, such as polyolefin film (e.g., polypropylene including biaxially oriented polypropylene, polyester film, polyamide film, cellulose ester film).

In accordance with one aspect of the invention, coarse sandpaper 10 includes a non-slip coating layer 14, which defines a non-slip, or slip resistant, outer surface 14*a* of the coarse sandpaper 10. Non-slip coating layer 14 is provided on the first major surface 12*a* of the back side of backing layer 12, e.g. the side opposite the make coat 16 and coarse abrasive particles 18. "Non-slip" coating layers refer to coatings that increase the coefficient of friction of the backing layer surface to which the non-slip material is applied. That is, if the surface of the backing layer 12*a* to which a non-slip coating layer is applied has a coefficient of friction of "x" prior to when the coating is applied, and the coating—as applied to the surface of the backing—provides a surface that has a coefficient of friction that is greater than "x", then the coating is a "non-slip" coating. Or stated another way, if the coating tends to increase the coefficient of friction of the backing surface to which it is applied, then the coating qualifies as a "non-slip" coating.

In one embodiment, the non-slip coating layer 14 has an average peak static coefficient of friction of at least about 1 gram, at least about 1.25 grams, or at least about 1.5 grams when measured generally according to ASTM D 1894-08 (Standard Test Method for Static and Kinetic Coefficients of Friction of Plastic Film and Sheeting) at 23° C. using an IMASS slip/peel tester (SP2000, commercially available from Instrumentors Inc., Strongsville, Ohio), and/or an average kinetic coefficient of friction of at least about 0.75 grams, at least about 1 gram, or at least about 1.25 grams.

In various embodiments, non-slip coating layer 14 outer surface 14*a* may have no tack, or may have a low level of tack. If the non-slip coating is tacky, it may be desirable that the tack be kept to a low level. By a low level of tack, it is meant that the non-slip coating has an average tack level, as measured by an Inverted Probe Test (i.e., a test procedure in general accordance with the procedures described in ASTM D2979-88 (Standard Test Method for Tack of Pressure-Sensitive Adhesives Using an Inverted Probe Machine), using a ten (10) second dwell time, and a probe removal speed of one (1) cm/s), of no greater than about 350 grams. In various embodiments, non-slip coating 14 may have an average tack level, as measured by an Inverted Probe Test, of no greater than about 40 grams, of no greater than about 60 grams, of no greater than about 100 grams, of no greater than about 200 grams, no greater than about 250 grams, or no greater than about 300 grams. A low level of tack may serve to differentiate non-slip layer 14 from conventional pressure-sensitive adhesives as are customarily used for attachment; thus, in at least some embodiments, a non-slip layer as defined and disclosed herein may not be equated with conventional pressure-sensitive adhesives e.g. as may sometimes be used to attach sandpaper to sanding blocks, vibrating or orbital sanders, and the like (and which may often display a tack in the range of 500-600). In further embodiments, non-slip coating 14 may comprise a tack level of at least about 5 grams, of at least about 10 grams, or at least about 15 grams.

In some embodiments, non-slip coating 14 may comprise an adhesion to itself that is less than the cohesive strength of the non-slip coating itself, and further may have an adhesion to itself that is less than the "two-bond" adhesive strength. As is known to those skilled in the art, the "two-bond" adhesive strength is the adhesive strength between non-slip coating 14 and backing layer 12 to which the non-slip coating layer is applied. Thus, when non-slip coating 14 is folded over onto itself, the areas of the surface of the non-slip coating that come into contact with each other can be released from each other without experiencing cohesive failure of the non-slip layers, and without having any portion of non-slip coating layer 14 detach from backing layer 12.

In some embodiments, the non-slip coating provides a surface that may be repeatably bonded to itself. In another somewhat related aspect, non-slip coating 14 may be repositionable. As used herein, "repositionable" refers to a non-slip coating that allows repeated application, removal, and reapplication to and from itself or a surface without damage to the non-slip coating or the surface.

In addition, it is desirable that the adhesion of non-slip coating layer 14 to itself not build significantly over time. As such, if coarse abrasive article 10 is folded over onto itself such that areas of the surface of the non-slip layer come into contact with each other, coarse abrasive article 10 may later be readily unfolded by separating the contacted surface areas of non-slip coating layer 14 without damaging non-slip coating 14 or backing layer 12.

In various embodiments, the non-slip coating layer may have a glass transition temperature of at least about −80 degrees Celsius (° C.), at least about −60° C., and at least about −40° C., and a glass transition temperature of no greater than about 5° C., no greater than about −5° C., and no greater than about −15° C.

In various embodiments, non-slip coating layer 14 may comprise a thickness (e.g., an average thickness as measured in several locations) of at least about 10 microns, at least about 15 microns, at least about 20 microns, or at least about 25 microns. In further embodiments, non-slip coating layer 14 may comprise a thickness of at most about 200 microns, at most about 100 microns, at most about 50 microns, or at most about 40 microns.

In various embodiments, non-slip coating layer 14 may comprise a coating weight (e.g., an average coating weight as measured in several locations) of at least about 10 grams per square meter, at least about 15 grams per square meter, at least about 20 grams per square meter, or at least about 25 grams per square meter. In further embodiments, non-slip coating layer 14 may comprise a coating weight of at most about 200 grams per square meter, at most about 100 grams per square meter, at most about 60 grams per square meter, or at most about 25 grams per square meter.

In some embodiments, non-slip coating layer 14 may be an essentially dense material (e.g., without any porosity or internal void volume other than the occasional voids, free volume, etc., as are known to those of skill in the art to be sometimes present in most polymeric materials). In embodiments in which non-slip coating layer 14 is an essentially dense material, non-slip coating layer 14 by definition will not encompass a sponge or foam layer of a so-called sanding sponge. In various embodiments, non-slip coating layer 14 may comprise a density of at least about 0.9 grams/cc, at least about 0.95 grams/cc, or at least about 1.0 grams/cc.

As mentioned, and as pictured in the embodiment illustrated in the FIGURE, non-slip coating 14 defines an outer surface 14*a* of coarse sandpaper 10 opposite make coat 16 and coarse abrasive particles 18. In some embodiments outer surface 14*a* may be a generally planar surface that by definition does not include a textured pattern or a visually observable three dimensional surface topography. In other embodiments, the outer surface of non-slip coating 14 may comprise a textured or patterned surface. This might be achieved e.g. by performing the coating process in such manner as to impart a non-smooth outer surface. Or, non-slip coating layer 14 may further comprise filler material or particles to provide the non-slip coating layer 14 outer surface 14*a* with a rough or randomly textured surface. Such a rough, textured or patterned surface may serve to enhance the non-slip properties of non-slip coating layer 14.

Non-slip coating layer 14 may be continuous, discontinuous, and/or applied in random, irregular, or repeating patterns, such as dots and stripes. As such, in various embodiments non-slip coating layer may occupy at least about 25%, at least about 50%, at least about 75%, or at least about 90%, of the surface area of the back side of backing 12. In specific embodiments, the entirety of the back side of backing 12 (e.g. surface 12*a* of backing 12) is occupied by non-slip coating layer 14. In some embodiments, non-slip coating layer 14 may be clear. In this manner, any information or indicia printed on backing layer 12 will remain visible through non-slip coating layer 14. In addition, the appearance of the coarse sandpaper may remain similar to the appearance of conventional sandpaper, to which users have become accustomed. In other embodiments, non-slip coating layer 14 may be colored, pigmented, etc., for any effect as desired. In some embodiments, non-slip coating layer 14 is permanently bonded to backing 12 (either directly to surface 12*a* of backing 12, or via an intermediate tie layer, primer layer or the like).

Non-slip coating layer 14 comprises at least one base resin. A base resin may comprise any suitable polymeric material that provides mechanical integrity and toughness to the non-slip coating layer, but that may not necessarily (in the absence of the tackifying resin) supply the desired non-slip properties disclosed herein. Suitable base resins for non-slip coating layer 14 may include, for example: natural and synthetic rubbers such as synthetic polyisoprene, butyl rubbers, polybutadiene, styrene-butadiene rubber (SBR), carboxylated styrene-butadiene rubber, block copolymers such as Kraton rubber, polystyrene-polyisoprene-polystyrene (SIS) rubber, styrene-butadiene-styrene (SBS) rubber, nitrile rubber (Buna-N rubbers), hydrogenated nitrile rubbers, acrylonitrile-butadiene rubber (NBR), chloroprene rubber, polychloroprene, neoprene, EPM rubber (ethylene propylene rubber), EPDM rubber (ethylene propylene diene rubber), ethylene-propylene-butylene terpolymers, acrylic rubber, polyacrylic rubber, silicone rubber; copolymers such as ethylene-vinyl acetate (EVA) copolymers, ethylene-(meth)acrylate copolymers, ethylene-vinyl acetate-maleic anhydride and/or ethylene-(meth)acrylate-maleic anhydride terpolymers; and other polymeric materials such as polyvinyl acetates, grafted polyvinyl acetates or EVA copolymers, polyamides, polyesters, thermoplastic elastomers, thermoplastic vulcanizates such as Santoprene thermoplastic rubber, thermoplastic polyurethanes, and thermoplastic olefins and amorphous polyolefins.

In some embodiments, the at least one base resin may comprise a poly(vinyl ether) polymer, e.g. an amorphous poly(alkyl vinyl ether) polymer such as amorphous poly (methyl vinyl ether). In some embodiments, the at least one base resin may comprise a polyolefin, e.g. a polyethylene, polypropylene, polybutene, and/or copolymers (including terpolymers) thereof. In certain embodiments, such a polyolefin may comprise a grafted polyolefin, e.g. a polyethylene with a saponification number of at least three, and which may be grafted e.g. with polycarboxylic acids, anhydrides, esters thereof, or the like. In certain other embodiments, such a polyolefin may comprise a metallocene (catalyzed) polyolefin, for example a functionalized metallocene polyethylene polymer or copolymer. Such polymers or copolymers may be functionalized e.g. with acids such as acrylic acid, acetates, sulfonates, maleic anhydrides, or the like.

In some embodiments, the base resin may comprise an amorphous polymer. By amorphous is meant a polymer that displays essentially no crystallinity, as evidenced by no, or at most a very weak (i.e., barely discernible), melting point(s) on a Differential Scanning calorimetry curve, as will be appreciated by those of ordinary skill. In various specific embodiments, an amorphous polymer may comprise an amorphous hydrocarbon polymer or copolymer (such as, e.g., polyolefin polymers and/or copolymers containing ethylene, propylene, higher alkenes, and/or copolymers thereof, polymers and/or copolymers of higher order dienes, polymers and/or copolymers of poly-alpha olefins, etc.); or, an amorphous heteroatom polymer or copolymer (such as, e.g. polyolefin-poly(meth) acrylate copolymers, polyolefin-EVA copolymers, poly(vinyl ether) polymers and/or copolymers, and the like). In some embodiments, the amorphous polymer may comprise atactic polypropylene and/or copolymers thereof. In some embodiments, the amorphous polymer is an aliphatic polymer (i.e., not comprising aromatic units). In some embodiments, the base resin consists essentially of an amorphous polymer or copolymer or of mixtures of amorphous polymers or copolymers. In some embodiments, the amorphous polymer may comprise a poly-alpha-olefin hydrocarbon copolymer (e.g., terpolymer) containing propyl, ethyl, and butyl monomer units (e.g., obtained by the copolymerization of propylene, ethylene, and 1-butene). In particular embodiments, the amorphous polymer may comprise, or may consist essentially of, a propylene-rich poly-alpha-olefin polymer, meaning a copolymer containing at least about 70 mole % of propylene-derived monomer units and from about 5 mole % to about 15 mole % of 1-butene-derived monomer units, with the balance being chosen from any other suitable monomer units, e.g. ethylene. The above list is meant to be representative, not exhaustive. Blends, mixtures, etc. of any of the above base resins may be used if desired. In various embodiments, the base resin (or resins, collectively) may comprise at least about 10, 20, 30 or 40 wt. % of non-slip coating layer 14. In further embodiments, the base resin(s) may comprise at most about 80, 70, 60, or 50 wt. % of non-slip coating layer 14.

Non-slip coating layer 14 comprises an effective amount of at least one tackifying resin. A tackifying resin may comprise any material (e.g., polymeric material) that may not necessarily comprise acceptable mechanical integrity by itself, but that when present at an effective amount along with the base resin, supplies the combination of resins with the desired non-slip properties disclosed herein. By an effective amount of tackifying resin is meant an amount sufficient to satisfactorily provide the non-slip properties disclosed herein (e.g., whether measured quantitatively by way of a coefficient of friction and/or tack test as disclosed earlier herein, or qualitatively by way of manually handling and sanding with an abrasive article comprising the non-slip coating layer). By an effective amount is further meant an amount that is lower than a threshold level that would cause the non-slip coating layer to be a conventional pressure-sensitive adhesive.

Suitable tackifying resins for non-slip coating layer 14 may include, for example: polymeric terpenes, hetero-functional terpenes, coumarone-indene resins, rosin acids, esters of rosin acids, disproportionated rosin acid esters, hydrogenated rosin acids, $C_5$ aliphatic resins, $C_9$ aromatics, $C_9$ hydrogenated aromatic resins, $C_5/C_9$ aliphatic/aromatic resins, dicyclopentadiene resins, hydrogenated pinene polymers or copolymers, hydrogenated hydrocarbon resins arising from $C_5/C_9$ and dicyclopentadiene precursors, hydrogenated styrene monomer resins, alpha-methyl styrene resins, hydrogenated mixed aromatic tackifying resins, aliphatic/aromatic hydrocarbon liquid tackifying resins; napthenic oils, mineral oils, alkyl phenolic tackifying resins, and the like. Additionally potentially suitable tackifying resins may include, for example: alpha-methylstyrene; copolymers of alpha-methylstyrene and styrene; hydrogenated cyclopentadienes, a rosin or a terpene resin of the alpha-pinene, beta-pinene and d-limonene types; wood rosins or gum rosins; rosin esters derived from either gum or wood rosin, such as glycerol esters (ester gums), pentaerythritol esters, hydrogenated, polymerized or disproportionated gum or wood rosins; polyhydric alcohol derivatives of hydrogenated rosin, such as glycerol derivatives or polyhydroalcohol derivatives of polymerized rosins; e.g. ethylene glycol ester, glycerol esters, oxidized rosins, hydrogenated oxidized rosin esters of oxidized rosin and the like. Still other potentially suitable tackifying resins may include e.g. hydrocarbon resins such as polyterpenes, synthetic polyterpenes, and those materials obtained from the polymerization of olefins and diolefins (e.g., the aliphatic olefin derived tackifying resins available from the Sartomer Company of Exton, Pa. under the trade designation Wingtack). Still other potentially suitable tackifying resins include e.g. terpene polymers such as the polymeric, resinous materials obtained by polymerization and/or copolymerization of terpene hydrocarbons such as the alicyclic, monocyclic, and bicyclic monoterpenes and their mixtures, including allo-ocimene, carene, isomerized pinene, pinene, dipentene, terpinene, terpinolene, limonene, turpentine, a terpene cut or fraction, and various other terpenes. In some embodiments, the tackifying resin(s) is a hydrocarbon material; in particular embodiments, the tackifying resin(s) is an aliphatic hydrocarbon material. Such materials may be e.g. branched hydrocarbon polymers.

The above list is meant to be representative, not exhaustive. Blends, mixtures, etc. of any of the above tackifying resins may be used if desired. In various embodiments, the tackifying resin (or resins, collectively) may comprise at least about 5, 10, 15, 20, or 25 wt. % of non-slip coating layer 14. In further embodiments, the tackifying resin(s) may comprise at most about 50, 40, or 30 wt. % of non-slip coating layer 14.

Non-slip coating layer 14 may optionally comprise at least one wax, by which is meant a relatively low molecular weight material that may modify or enhance various properties of the non-slip coating layer. Any suitable natural (e.g., animal, vegetable, mineral, or petroleum based) or synthetic wax may be used. Such waxes may include e.g. hydrocarbon waxes, paraffin waxes, microcrystalline waxes, fatty amide waxes, hydroxy stearamide waxes, vinyl acetate-modified waxes, maleic anhydride-modified waxes, high density low molecular weight (e.g., less than approximately 2500) polyethylene waxes, and the like.

The above list is meant to be representative, not exhaustive. Blends, mixtures, etc. of any of the waxes may be used if desired. In various embodiments, the waxes (or waxes, collectively) may comprise at least about 2, 5, or 10 wt. % of non-slip coating layer 14. In further embodiments, the wax(es) may comprise at most about 40, 30, or 20 wt. % of non-slip coating layer 14.

Any other desirable ingredients may be included in non-slip coating layer 14 as long as they do not unacceptably affect the non-slip property. Such additives may include e.g. processing aids, extrusion aids, antioxidants, wetting agents, UV stabilizers, nucleating agents, plasticizers, pigments, dyes, fillers, and so on.

In some embodiments, non-slip coating layer 14 consists essentially of at least one base resin, at least one tackifying resin, and at least one wax along with optional minor quantities of additives such as processing aids, antioxidants and the like.

In general, any adhesive make coat 16 may be used to adhere the coarse abrasive particles 18 to the backing layer 12. "Make coat" refers to the layer of hardened resin over the backing layer 12 of the coarse sandpaper 10. Suitable materials for the adhesive make coat 16 include, for example, phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. The make coat 16 may be coated onto the backing layer 12 by any conventional technique, such as knife coating, spray coating, roll coating, rotogravure coating, curtain coating, and the like. The coarse sandpaper 10 may also include an optional size coat (not shown). The make coat 16 and/or an optional size coat may contain optional additives, such as fillers, fibers, lubricants, grinding aids, wetting agents, thickening agents, anti-loading agents, surfactants, pigments, dyes, coupling agents, photo-initiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as is known to those skilled in the art.

In some embodiments, adhesive make coat 16 consists of a single layer. In such embodiments, the combination of backing layer 12 and adhesive make coat 16 does not encompass configurations involving three or more layers, e.g. a backing layer bearing a binder layer thereupon, which binder layer bears an adhesive layer thereupon.

In general, any coarse abrasive particles 18 may be used with this invention. As defined herein, the term "coarse" means having a FEPA P grade, as outlined by the Federation of European Producers of Abrasives and as tested in accordance with the ISO 6344 standard, of P100 or lower (with a lower grade corresponding to larger particles). In various embodiments, the coarse abrasive particles and the coarse abrasive article comprising the coarse abrasive particles, may comprise an FEPA grade of P80, of P60, or of P40.

Suitable coarse abrasive particles may include, for example, fused aluminum oxide, heat treated aluminum oxide, alumina-based ceramics, silicon carbide, zirconia, alumina-zirconia, garnet, emery, diamond, ceria, cubic boron nitride, ground glass, quartz, titanium diboride, sol gel coarse abrasives and combinations thereof. The coarse abrasive particles 18 can be either shaped (e.g., rod, triangle, or pyramid) or unshaped (i.e., irregular). The term "coarse abrasive particle" encompasses coarse abrasive grains, agglomerates, or multi-grain abrasive granules, as long as the specified FEPA grade is met. The coarse abrasive particles can be deposited onto make coat 16 by any conventional technique such as electrostatic coating or drop coating.

Coarse abrasive article 10 may be produced using any suitable technique; the choice of the most convenient technique may depend e.g. on the particular materials used to produce non-slip coating layer 14. For example, coarse abrasive article 10 may be made by providing a backing layer (e.g., a paper backing), coating an adhesive make coat on one major surface of the backing layer, at least partially embedding coarse abrasive particles in the make coat, thereby forming a coarse abrasive surface, and hot-melt coating a non-slip coating material, such as a mixture of base resin and tackifying resin, onto the surface of the backing layer opposite the make coat, and allowing the coated hot-melt coating to cool and solidify. Using this technique, non-slip coating layer 14 is said to be "hot-melt coated" onto the backing. In such embodiments, the materials making up non-slip coating layer 14 may collectively comprise a hot-melt coatable, 100% solids mixture (e.g., with little or no solvent, water, etc.). Non-slip coating layer 14 may be hot-melt coated onto backing layer 12 using, for example, roll coating, extrusion coating, or drop die coating techniques.

In another method of making coarse abrasive article 10, an aqueous emulsion or aqueous dispersion of a non-slip coating material may be coated onto backing layer 12 opposite make coat 16, and the water dried, thereby forming non-slip coating layer 14. In another method of making coarse abrasive article 10, a solution (e.g., in an organic solvent or solvent mixture) of a non-slip coating material may be coated onto backing layer 12 opposite make coat 16, and the solvent evaporated, thereby forming non-slip coating layer 14. In still another method of making the coarse abrasive material, a non-slip coating material precursor (e.g., comprising a mixture of polymerizable components that may be reacted so as to form the non-slip coating) may be coated onto backing layer 12 opposite make coat 16, and caused to react, causing the precursor to be transformed into the non-slip coating.

In the context of the above approaches, the term coating encompasses any process involving deposition of a flowable coating material or coating material precursor, including spraying and like methods.

If it is desired that the outer surface 14*a* of non-slip coating 14 is to be textured (instead of having a generally planar surface), this can be arranged by any suitable method either during, or after the coating of non-slip layer 14 onto the back side of backing 12. In one embodiment, a foam roller may be used to apply the coatable non-slip material, which may impart a surface texture to the non-slip coating layer. Alternatively, a foam roller may be used to post treat the non-slip coating layer 14 after it has been coated onto backing layer 12, thereby imparting the non-slip coating layer with a surface texture.

Those of ordinary skill will appreciate that any of the above methods may be used. In any of the above techniques, it will be recognized that the order in which non-slip coating layer 14 and made coat layer 16 are applied to backing layer 12 may be varied. That is, non-slip coating layer 14 may be applied to backing layer 12 either before or after make coat 16 is applied to backing layer 12. In addition, it will be recognized that backing layer 12, make coat 16, and coarse abrasive particles 18 may be provided in the form of a pre-formed (i.e. otherwise complete) coarse abrasive sheet. That is, rather than providing a backing layer 12 comprising a non-slip layer on one surface thereof, and then coating the other surface of the backing layer with make coat 16 and then depositing coarse abrasive particles 18 thereupon to form a coarse abrasive sheet, a pre-formed coarse abrasive sheet including a backing, make coat and coarse abrasive particles may be provided. The non-slip coating layer 14 can then be applied directly to the back side of the pre-formed coarse abrasive sheet.

If a pre-formed coarse abrasive sheet is used, the non-slip coating layer 14 may be applied to the backing layer 12 of the pre-formed coarse abrasive sheet using, for example, any of the above techniques. For ease of manufacturing, it may be desirable to provide the pre-formed coarse sandpaper in bulk form (e.g., as a roll good), and then coat the bulk coarse sandpaper with the non-slip coating material prior to producing the individual sheets of coarse sandpaper that are ultimately used by the end user.

Any suitable pre-formed coarse abrasive (whether sheet or roll good) may be used, comprising a wide variety of commercially available conventional coarse sandpaper constructions having a wide variety of backing materials (e.g. papers, films, cloths), weights (e.g. A, B, or C weight paper), and coarse abrasive particles. Representative examples of suitable pre-formed coarse abrasive articles are available under the trade designation 340U, from 3M Company, St. Paul, Minn. 340U is a coarse sandpaper having a C weight paper backing and coarse abrasive particles of FEPA grade P80 (corresponding to an average abrasive particle size in the range of about 200 microns). Other representative examples of coarse abrasive articles include various products available from 3M Company (e.g., under the Sand-Blaster or Pro Grade trade designations) with FEPA ratings of P100, P60, or P40, corresponding respectively to an average coarse abrasive particle size in the range of about 160, 270 and 430 microns. In this regard, it will be noted that "coarse" abrasives, articles and sandpaper as defined and disclosed herein may encompass products which may be variously termed extra coarse, medium coarse, macrogrit, and so on.

In a specific embodiment, coarse sandpaper 10 may be provided to an end user as a standard 9×11 inch sheet. In other embodiments, the coarse sandpaper 10 may have a width of about 3 to about 4 inches, or of about 5 to about 6 inches, and a length of about 8 to about 10 inches, or about 10 to about 12 inches. In another aspect, the present invention provides a package of coarse sandpaper including a stack of sheets of coarse sandpaper. The stack may include at least 2 sheets, at least about 6 sheets, or at least about 10 sheets. Optionally, disposable liners, protective films, etc. may be provided in between the sheets, if desired.

In some end use applications, the sheet-like coarse abrasive article 10 may be used for hand sanding a work surface, such as a wooden surface or work piece. That is, the coarse abrasive article 10 may be used to remove material from a surface by holding the coarse abrasive article 10 directly with one's hand (i.e. without the aid of a tool, such as a sanding block), and moving the coarse abrasive article 10 against the work surface. Thus in this context hand sanding is distinct from operations in which sandpaper is held and motivated by a device such as a polishing shoe, vibrating or orbital sander, and the like. However, it will be recognized that the coarse abrasive articles disclosed herein may also be used with manually-operated sanding tools and sanding blocks, or with powered equipment, as may be desired.

In use, users may often fold an abrasive article (e.g., sandpaper), thereby producing sheets that are easier to handle by hand. Folding the sandpaper, however, may weaken the sandpaper along the fold line, particularly if, during sanding, the sections of the folded sandpaper slip relative to each other so that the fold line moves along the sandpaper. Such moving of a fold line along an abrasive article may e.g. cause the backing to weaken, crack, etc. over portions of the article, and may thus reduce the working life of the abrasive article. It has been discovered that the use of a non-slip coating on the back side of an abrasive article may minimize or prevent such slipping from occurring. That is, in hand sanding with an abrasive sheet that is folded upon itself so that areas of the non-slip coating of the article back side are adjacent each other in closely facing relation, even in the presence of loose particulates the non-slip coating areas may be able to resist slipping relative to each other, so that the sheet remains basically in the originally folded configuration rather than the areas slipping relative to each other such that the fold in the sheet moves along the sheet. Such discoveries and methods of applying and using non-slip coating layers are discussed in U.S. Patent Application Publication US 2009/0325470 to Petersen, filed Jun. 15, 2009, entitled Sandpaper With Non-Slip Coating Layer, which is incorporated by reference in its entirety herein.

It has been discovered, however, that in some uses of a coarse abrasive article as disclosed herein, an issue may arise. Specifically, loose coarse particulates which may be generated e.g. during the handling and normal use of a coarse abrasive article may come in contact with the surface of a non-slip coating layer on the back side of the article and may undesirably reduce the non-slip property of the non-slip layer, as evidenced in Comparative Example 1. Without wishing to be limited by theory or mechanism, it is postulated that a sufficient number of loose coarse particulates may act somewhat as rolling-element bearings (e.g., ball bearings) which may cause or facilitate slipping of the areas relative to each other. It has been determined that such an issue may not necessarily arise e.g. in the normal use of non-coarse abrasive articles, as evidenced e.g. by Comparative Example 2 and Other Comparative Examples herein. In this context, normal use is differentiated from severe use, severe use meaning a use in which very large quantities of loose particulates are generated so as to result in gross contamination of the back side of the sandpaper with particulates. (In this context, gross contamination may be considered to be in the general range of 500 or more particles per square centimeter of backing area, with normal use corresponding to less than 100 particles per square centimeter).

It has now been discovered that a non-slip coating layer as defined herein, comprising at least a base resin and a tackifying resin, may preserve the non-slip property of even coarse abrasive articles during their normal use. This ability is unexpected in view of the fact that the effect can be observed e.g. with coarse abrasive articles comprising coarse abrasive particles with a FEPA rating of P60, which corresponds to an average particle size of approximately 270 microns. The findings that (as evidenced in the Representative Working Example and Variations herein) non-slip coating layers of e.g. approximately 25-42 microns thickness are able to exert the effects disclosed herein during the normal use of abrasive articles comprising abrasive particles in the size range of e.g. 270 microns (and which would thus be expected to generate at least some loose coarse particulates in this size range in the course of normal use of the abrasive article), is unexpected. That is, it is unexpected that a non-slip coating that is so much thinner than the size of at least some of the loose coarse particulates could have such an effect in preventing the loose coarse particulates from acting as rolling-element bearings and thus could maintain the non-slip property disclosed herein. In this context, it is noted that certain coatings (e.g., not containing at least one tackifying resin) have been found to not possess this ability in normal use of coarse abrasives, as evidenced in Comparative Example 1.

The effect is also unexpected given that at least some of the tackifying resin-containing materials that have been found to be effective as non-slip materials (and that retain their non-slip property even in the presence of loose coarse particulates) are conventionally used as laminating adhesives (i.e., sandwiched between two substrates) rather than being used in an exposed condition as disclosed herein. In summary, there is no known teaching that would lead one of ordinary skill to expect that an exposed coating layer of a relatively low thickness, e.g. comprising a base resin and a tackifying resin, would exhibit the ability to preserve non-slip properties even in the presence of loose coarse particulates that are many times greater in size than the thickness of the coating layer.

It has further been found that another issue may also arise in instances in which gross contamination of the non-slip backing with particulates (not necessarily limited to coarse particulates) occurs. Such issues may arise e.g. in sanding under severe conditions (e.g. of very heavy and aggressive use). Non-slip coating compositions, methods and so on which may be employed in such cases are disclosed in U.S.

Provisional Patent Application Ser. No. 61/451,680, entitled Sandpaper With Non-Slip Layer, filed Mar. 11, 2011.

LIST OF EXEMPLARY EMBODIMENTS

Embodiment 1

A sheet of coarse sandpaper, comprising: (a) a flexible backing layer having opposed first and second major surfaces; (b) an adhesive make coat on the second major surface; (c) coarse abrasive particles at least partially embedded in the make coat, thereby defining a coarse abrasive surface; and (d) an exposed non-slip coating layer on the first major surface, wherein the nonslip coating layer comprises a base resin and an effective amount of a tackifying resin.

Embodiment 2

A sheet of coarse sandpaper as defined in embodiment 1, wherein the non-slip coating layer is a hot-melt coating layer.

Embodiment 3

A sheet of coarse sandpaper as defined in any of embodiments 1-2, wherein the flexible backing layer consists of a single layer, wherein the adhesive make coat consists of a single layer in direct contact with the second major surface of the adhesive make coat, and wherein the non-slip coating layer consists of a single layer.

Embodiment 4

A sheet of coarse sandpaper as defined in any of embodiments 1-3, wherein the non-slip coating layer has an average tack level, as measured by an Inverted Probe Test using a 10 second dwell time and a probe removal speed of 1 cm/s, of no greater than about 250 grams.

Embodiment 5

A sheet of coarse sandpaper as defined in any of embodiments 1-4, wherein the non-slip coating layer has an average tack level, as measured by an Inverted Probe Test using a 10 second dwell time and a probe removal speed of 1 cm/s, of no greater than about 60 grams.

Embodiment 6

A sheet of coarse sandpaper as defined in any of embodiments 1-5, wherein the non-slip coating layer has an average kinetic coefficient of friction of at least about 0.75 grams when measured according to ASTM D 1894-08.

Embodiment 7

A sheet of coarse sandpaper as defined in any of embodiments 1-6, wherein the non-slip coating layer, when bonded to itself, has an adhesion that is less than the two-bond adhesion of the non-slip coating layer to the backing layer, whereby the non-slip coating layer does not separate from the backing layer when the non-slip coating layer is separated from itself.

Embodiment 8

A sheet of coarse sandpaper as defined in any of embodiments 1-7, wherein the non-slip coating layer, when bonded to itself, has an adhesion level that is less than the cohesive strength of the non-slip coating layer, whereby the non-slip coating layer is not damaged when the non-slip coating layer is separated from itself.

Embodiment 9

A sheet of coarse sandpaper as defined in any of embodiments 1-8, wherein the non-slip coating layer has a thickness of at least about 20 microns and no greater than about 50 microns.

Embodiment 10

A sheet of sandpaper as defined in any of embodiments 1-9, wherein the non-slip coating layer has a coating weight of at least about 15 g/m$^2$ and no greater than about 100 g/m$^2$.

Embodiment 11

A sheet of coarse sandpaper as defined in any of embodiments 1-10, wherein the non-slip coating layer comprises a generally planar outer surface opposite the coarse abrasive particles.

Embodiment 12

A sheet of coarse sandpaper as defined in any of embodiments 1-11, wherein the flexible backing layer is paper having a weight ranging from an A weight to an F weight.

Embodiment 13

A sheet of coarse sandpaper as defined in any of embodiments 1-12, wherein the non-slip coating layer exhibits a glass transition temperature in the range of about −40° C. to about −5° C.

Embodiment 14

A sheet of coarse sandpaper as defined in any of embodiments 1-13, wherein the base resin comprises an amorphous polymer.

Embodiment 15

A sheet of coarse sandpaper as defined in any of embodiments 1-14, wherein the base resin comprises an amorphous hydrocarbon polymer.

Embodiment 16

A method of hand sanding a work surface comprising the steps of: (a) providing a sheet of coarse sandpaper as defined in any of embodiments 1-15 and 17; (b) manually engaging the non-slip coating layer with at least one of a hand and a manually operated tool; and (c) manually moving the sandpaper in a plurality of directions over the work surface.

Embodiment 17

A sheet of coarse sandpaper for hand sanding a work surface comprising: (a) a paper backing layer having opposed first and second major surfaces; (b) an adhesive make coat on the backing layer second major surface; (c) coarse abrasive particles at least partially embedded in the adhesive make coat, thereby defining a coarse abrasive surface; and (d) an exposed non-slip coating layer on the backing layer first major surface, wherein the non-slip coating layer is a hot-melt coating layer comprising a base resin and a tackifying resin, the non-slip coating layer comprising a thickness of no greater than about 50 microns and wherein the entirety of the outer surface of the non-slip coating layer is a generally planar surface.

Embodiment 18

A method of making a sheet of coarse sandpaper having a non-slip coating layer, comprising the steps of: (a) providing a paper backing layer having opposed first and second major surfaces; (b) coating an adhesive make coat on the second major surface; (c) at least partially embedding abrasive particles in the make coat, thereby forming an abrasive surface; and (d) hot-melt coating a non-slip coating layer comprising at least one base resin and at least one tackifying resin on the first major surface.

In order that the invention described herein can be more fully understood, the following examples are set forth. It should be understood that these examples are for illustrative purposes only, and are not to be construed as limiting this invention in any manner.

EXAMPLES

Representative Working Example

A length of coarse sandpaper of the type available from 3M Company, St. Paul, Minn. under the product designation "340U P80 Paper C Wt." was obtained as a roll good. The product comprised a FEPA grade of P80, corresponding to an average abrasive particle size in the range of about 200 microns, and a backing of C-weight paper. A hot-melt laminating adhesive was obtained from Beardow-Adams of Milton Keynes, UK, under the trade designation PRODAS 1789. The adhesive was believed to comprise at least one organic polymeric base resin, at least one tackifying resin, and at least one wax. The at least one organic polymeric base resin appeared to be comprised of one or more amorphous polymers (i.e., essentially 100% amorphous polymers, with very weak melting points in the range of approximately 42° C. and 68° C.), with a glass transition temperature in the range of approximately −17° C. It was believed that the amorphous polymers were comprised substantially of hydrocarbon polymers. The hot-melt laminating adhesive was hot-melt coated onto the non-abrasive back side surface (i.e., opposite the coarse abrasive surface) of the coarse sandpaper using conventional hot-melt coating methods. The non-slip coating was coated at a coating weight of approximately 26 grams per square meter, corresponding to a coating thickness of approximately 25 microns. The non-slip coating layer exhibited a tack level (as measured with using the aforementioned Inverted Probe method) in the range of approximately 20-60 grams. The coarse sandpaper with the non-slip coating upon the back side thereof was rolled up as a roll good and cut into sheets that were then used for normal hand sanding of test surfaces. In this context, normal hand sanding can be distinguished from sanding under severe conditions, the effects of which on a non-slip layer may be evaluated e.g. by depositing gross quantities of particulates onto a non-slip layer (e.g., completely covering the layer with particulates and then shaking and brushing off the excess), and then evaluating the non-slip properties.

It was observed that the handling (e.g., cutting and stacking into sheets) and/or normal using of the sheets for sanding resulted in a visually observable quantity of loose coarse particulates coming into contact with the non-slip coating of the back side of the sheets. However, it was found in normal hand sanding tests that these loose coarse particulates did not appear to significantly (e.g., unacceptably) decrease the non-slip property of the non-slip coating. Specifically, in manual sanding with the coarse abrasive sheet folded upon itself so that surface areas of the non-slip coating of the article back side were adjacent each other in closely facing relation, for the most part the non-slip coating areas were able to resist slipping relative to each other, such that the sheet remained basically in the originally folded configuration rather than slipping so that the fold in the sheet moved along the folded sheet.

Additionally (in the absence of the contaminating particulates), the non-slip coating layer had a low level of tack that allowed the coarse abrasive article to be folded over onto itself so that areas of the non-slip surface were in contact with each other, and allowed the contacting surfaces to be readily separated from each other without damaging either of the non-slip coating layer surfaces, and without separating the non-slip coating layer from the underlying backing or damaging the backing.

Variations

Abrasive roll goods were obtained of a similar type to that of the Representative Working Example, except comprising coarse abrasive of FEPA grade of P60, corresponding to an average abrasive particle size in the range of about 270 microns, and in some cases comprising an FEPA grade of P40, corresponding to an average abrasive particle size in the range of about 425 microns. The roll goods were hot-melt coated with non-slip coatings of similar composition, and in similar manner, as in the Representative Working Example. Similarly to the Representative Working Example, the non-slip coating layer of these samples had a low level of tack that allowed the coarse abrasive article to be folded over onto itself so that areas of the non-slip surface were in contact with each other, and allowed the contacting surfaces to be readily separated from each other without damaging either of the non-slip coating layer surfaces, and without damaging or separating from the underlying backing. Additionally, in normal sanding tests, loose coarse particulates were observed to come into contact with the non-slip coating of the back side of the sheets; however, these loose coarse particulates did not appear to significantly (e.g., unacceptably) decrease the non-slip property of the non-slip coating. Specifically, in manual sanding with the coarse abrasive sheet folded upon itself so that areas of the non-slip coating were adjacent each other in closely facing relation, for the most part the non-slip coating areas were still able to resist slipping relative to each other.

Still other samples were generated with the coarse sandpaper and non-slip coating of the Representative Working Example, except that the non-slip coating was coated at a coating weight of up to approximately 44 grams per square meter (corresponding to a thickness of approximately 42 μm). Similar results were obtained to those of the Representative Working Example.

COMPARATIVE EXAMPLES

Comparative Example 1

A coarse sandpaper roll good of the type described in the Representative Working Example and Variations (FEPA P80 rating) was obtained. A non-slip coating material was obtained comprising a carboxylated styrene-butadiene rubber (SBR) base resin at 50% solids as an aqueous dispersion. No tackifying resin was believed to be present. The dispersion (available from BASF, Charlotte, N.C., under the trade designation Butofan NS 209) was coated onto the non-abrasive back side surface (i.e., opposite the coarse abrasive surface) of the coarse sandpaper using conventional dispersion coating methods and the water was dried to form a non-slip coating. The non-slip coating was present at a coating weight of approximately 30 grams per square meter, corresponding to a coating thickness of approximately 29 microns. The non-slip coating layer exhibited a tack level (as measured with using the aforementioned Inverted Probe method) of approximately zero (the tack was so low that the probe typically detached from the non-slip layer before the dwell time was complete). The coarse sandpaper with the non-slip coating upon the back side thereof was rolled up as a roll good and cut into sheets that were then used for normal hand sanding of test surfaces. It was observed that the handling (e.g., cutting and stacking into sheets) and/or using of the sheets for normal sanding resulted in a visually observable quantity of loose coarse particulates coming into contact with the non-slip coating of the back side of the sheets. It was found in normal hand sanding tests that these loose coarse particulates appeared to significantly decrease the non-slip property of the non-slip coating. Specifically, in manual sanding with the coarse abrasive sheet folded upon itself so that areas of the non-slip coating were adjacent each other in closely facing relation, the non-slip coating areas were often not able to resist slipping relative to each other, with the result that the fold (e.g., crease) in the coarse sandpaper sheet, rather than remaining basically at one location of the sheet, would move along the sheet as the slipping occurred. This process resulted, upon repeated normal sanding with the sheet, in the sheet being worked much more heavily, and the paper backing cracking and losing its strength in many more places, than in the Representative Working Example above.

Comparative Example 2

A length of non-coarse sandpaper of the type available from 3M Company, St. Paul, Minn. under the product designation "216U P180 Paper A Wt." was obtained as a roll good. This product comprised a FEPA grade of P180, corresponding to an average abrasive particle size in the range of about 80 microns, and a backing of C-weight paper. A non-slip coating material was obtained comprising a styrene-isoprene-styrene block copolymer (available from Kraton Polymers, LLC, Houston, Tex., under the trade designation D-1161K) at 90% by wt., and a tackifying hydrocarbon resin (available from Sartomer Company of Exton, Pa. under the trade designation Wingtack Plus) at 10% by wt., with the two components being collectively present at 40% solids by weight in toluene solution. The mixture was coated onto the backing of the abrasive sheet to a final thickness of approximately 38 microns using a knife coater, and was allowed to dry at ambient conditions to allow the toluene to completely evaporate.

Handling of this non-coarse abrasive article and/or normal sanding with this article was observed to result in a visually observable quantity of loose particulates that came into contact with the non-slip coating of the back side of the sheets. However, it was not observed that this appeared to significantly reduce the non-slip properties of the non-slip coating.

Other Comparative Examples

Other non-coarse grades of sandpaper (i.e., having FEPA grades of e.g. 150, 180, and so on, were obtained and had non-slip coatings applied to the back side thereof. The non-slip coatings were of the type described in Comparative Example 1 except that the coating weight was 10 grams per square meter, corresponding to a coating thickness of approximately 10 microns. Handling of these non-coarse abrasive articles and/or normal sanding with these articles was observed to result in a visually observable quantity of loose particulates that came into contact with the non-slip coating of the back side of the sheets. However, it was observed that this did not appear to significantly reduce the non-slip properties of the non-slip coating.

The tests and test results described above are intended solely to be illustrative, rather than predictive, and variations in the testing procedure can be expected to yield different results. All quantitative values in the Examples section are understood to be approximate in view of the commonly known tolerances involved in the procedures used. The foregoing detailed description and examples have been given for clarity of understanding only. No unnecessary limitations are to be understood therefrom.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

What is claimed is:

1. A sheet of coarse sandpaper, comprising:

(a) a flexible backing layer having opposed first and second major surfaces;

(b) an adhesive make coat on the second major surface;

(c) coarse abrasive particles at least partially embedded in the make coat, thereby defining a coarse abrasive surface; and (d) an exposed non-slip coating layer on the first major surface, wherein the nonslip coating layer comprises a base resin that comprises an amorphous hydrocarbon polymer or copolymer or a mixture thereof, and an effective amount of a tackifying resin, and wherein the non-slip coating layer has a thickness of at least about 20 microns and no greater than about 50 microns.

2. A sheet of coarse sandpaper as defined by claim 1, wherein the non-slip coating layer is a hot-melt coating layer.

3. A sheet of coarse sandpaper as defined in claim 1, wherein the flexible backing layer consists of a single layer, wherein the adhesive make coat consists of a single layer in direct contact with the second major surface of the adhesive make coat, and wherein the non-slip coating layer consists of a single layer.

4. A sheet of coarse sandpaper as defined in claim 1, wherein the non-slip coating layer has an average tack level, as measured by an Inverted Probe Test using a 10 second dwell time and a probe removal speed of 1 cm/s, of no greater than about 250 grams.

5. A sheet of coarse sandpaper as defined in claim 1, wherein the non-slip coating layer has an average tack level, as measured by an Inverted Probe Test using a 10 second dwell time and a probe removal speed of 1 cm/s, of no greater than about 60 grams.

6. A sheet of coarse sandpaper as defined in claim 1, wherein the non-slip coating layer has an average kinetic coefficient of friction of at least about 0.75 grams when measured according to ASTM D 1894-08.

7. A sheet of coarse sandpaper as defined in claim 1, wherein the non-slip coating layer, when bonded to itself, has an adhesion that is less than the two-bond adhesion of the non-slip coating layer to the backing layer, whereby the non-slip coating layer does not separate from the backing layer when the non-slip coating layer is separated from itself.

8. A sheet of coarse sandpaper as defined in claim 1, wherein the non-slip coating layer, when bonded to itself, has an adhesion level that is less than the cohesive strength of the non-slip coating layer, whereby the non-slip coating layer is not damaged when the non-slip coating layer is separated from itself.

9. A sheet of sandpaper as defined in claim 1, wherein the non-slip coating layer has a coating weight of at least about 15 $g/m^2$ and no greater than about 100 $g/m^2$.

10. A sheet of coarse sandpaper as defined in claim 1, wherein the non-slip coating layer comprises a generally planar outer surface opposite the coarse abrasive particles.

11. A sheet of coarse sandpaper as defined in claim 1, wherein the flexible backing layer is paper having a weight ranging from an A weight to an F weight.

12. A sheet of coarse sandpaper as defined in claim 1, wherein the non-slip coating layer exhibits a glass transition temperature in the range of about −40° C. to about −5° C.

13. A method of hand sanding a work surface comprising the steps of:

(a) providing a sheet of coarse sandpaper as defined in claim 1;

(b) manually engaging the non-slip coating layer with at least one of a hand and a manually operated tool; and (c) manually moving the sandpaper in a plurality of directions over the work surface.

14. A sheet of coarse sandpaper as defined in claim 1, wherein the base resin consists essentially of an amorphous hydrocarbon polymer or copolymer or a mixture thereof.

15. A sheet of coarse sandpaper as defined in claim 1, wherein the base resin consists essentially of amorphous aliphatic hydrocarbon poly-alpha-olefin polymers chosen from the group consisting of atactic polypropylene and copolymers thereof with ethylene and/or butylene, and wherein the tackifying resin consists essentially of an aliphatic hydrocarbon material.

* * * * *